US007601075B2

(12) United States Patent
Cole et al.

(10) Patent No.: US 7,601,075 B2
(45) **Date of Patent: *Oct. 13, 2009**

(54) METHODS AND APPARATUS FOR INTERCHANGEABLY COUPLING GOLD CLUB HEADS AND SHAFTS

(75) Inventors: Eric V. Cole, Phoenix, AZ (US); Brad D. Schweigert, Phoenix, AZ (US); John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/171,207

(22) Filed: Jul. 10, 2008

(65) Prior Publication Data

US 2008/0268977 A1 Oct. 30, 2008

Related U.S. Application Data

(62) Division of application No. 11/613,034, filed on Dec. 19, 2006, now Pat. No. 7,413,518.

(51) Int. Cl.
*A63B 53/04* (2006.01)

(52) U.S. Cl. ..... 473/288; 473/306; 473/307; 473/309; 403/300

(58) Field of Classification Search ..... 473/305–310, 473/288, 298–299

See application file for complete search history.

(56) References Cited

U.S. PATENT DOCUMENTS

| | | | |
|---|---|---|---|
| 682,960 | A | 9/1901 | Slazenger |
| 1,334,189 | A | 3/1920 | Swanson |
| 1,585,907 | A | 5/1926 | Miller |
| 1,715,586 | A | 6/1929 | Barkley |
| 1,895,417 | A | 1/1933 | Lard |
| 1,906,239 | A | 5/1933 | Reach |
| 1,930,204 | A | 10/1933 | Judd et al. |
| 1,982,087 | A | 11/1934 | Wantz |
| 2,027,452 | A | 1/1936 | Rusing |
| 2,129,068 | A | 9/1938 | Reach |
| 2,146,048 | A | 2/1939 | Barnhart |
| 2,464,850 | A | 3/1949 | Crawshaw |
| 5,385,346 | A | 1/1995 | Carroll et al. |
| 5,496,029 | A | 3/1996 | Heath et al. |
| 5,863,260 | A | 1/1999 | Butler, Jr. et al. |
| 5,951,411 | A | 9/1999 | Wood et al. |
| 6,039,659 | A | 3/2000 | Hamm |
| 6,431,993 | B1 | 8/2002 | Dyer |
| 7,017,252 | B2 | 3/2006 | Lenhof et al. |
| 7,083,529 | B2 | 8/2006 | Cackett et al. |
| 2004/0018886 | A1 | 1/2004 | Burrows |
| 2005/0176521 | A1 | 8/2005 | Burch et al. |
| 2006/0264266 | A1 | 11/2006 | Jung |
| 2007/0078026 | A1 | 4/2007 | Holt et al. |

FOREIGN PATENT DOCUMENTS

| | | |
|---|---|---|
| GB | 879553 | 10/1961 |
| GB | 899562 | 6/1962 |
| GB | 2109249 | 6/1983 |
| WO | WO 97/45172 | 12/1997 |

*Primary Examiner*—Stephen L. Blau

(57) ABSTRACT

Methods and apparatus for interchangeably coupling golf club heads and shafts are described herein. Other embodiments may be described and claimed.

30 Claims, 5 Drawing Sheets

METHODS AND APPARATUS FOR INTERCHANGEABLY COUPLING GOLD CLUB HEADS AND SHAFTS

CROSS REFERENCE TO RELATED APPLICATIONS

This application is a divisional application of U.S. patent application Ser. No. 11/613,034, filed Dec. 19, 2006, which is incorporated herein by reference.

TECHNICAL FIELD

The present disclosure relates generally to golf equipment, and more particularly, to methods and apparatus for interchangeably coupling golf club heads and shafts.

BACKGROUND

In some sports, equipment fitting processes may match individuals with equipment to help them play to the best of their abilities. In one example, individuals may be custom-fitted for a complete set of golf clubs (e.g., metal woods, irons, wedges, putter, etc.). Golf club fitters may provide various combinations of golf club heads and shafts for individuals to try out. To properly fit an individual with a set of golf clubs, a golf club fitter may determine various preferences and/or characteristics of the individual (e.g., gender, height, age, wrist-to-floor distance, swing speed, etc.). In one example, a golf club fitter may determine whether an individual prefers to play with either right-handed golf clubs or left-handed golf clubs so that the individual may be fitted with proper golf equipment.

DETAILED DESCRIPTION

In general, methods and apparatus for interchangeably coupling golf club heads and shafts are described herein. The methods and apparatus described herein are not limited in this regard.

Figure 1:
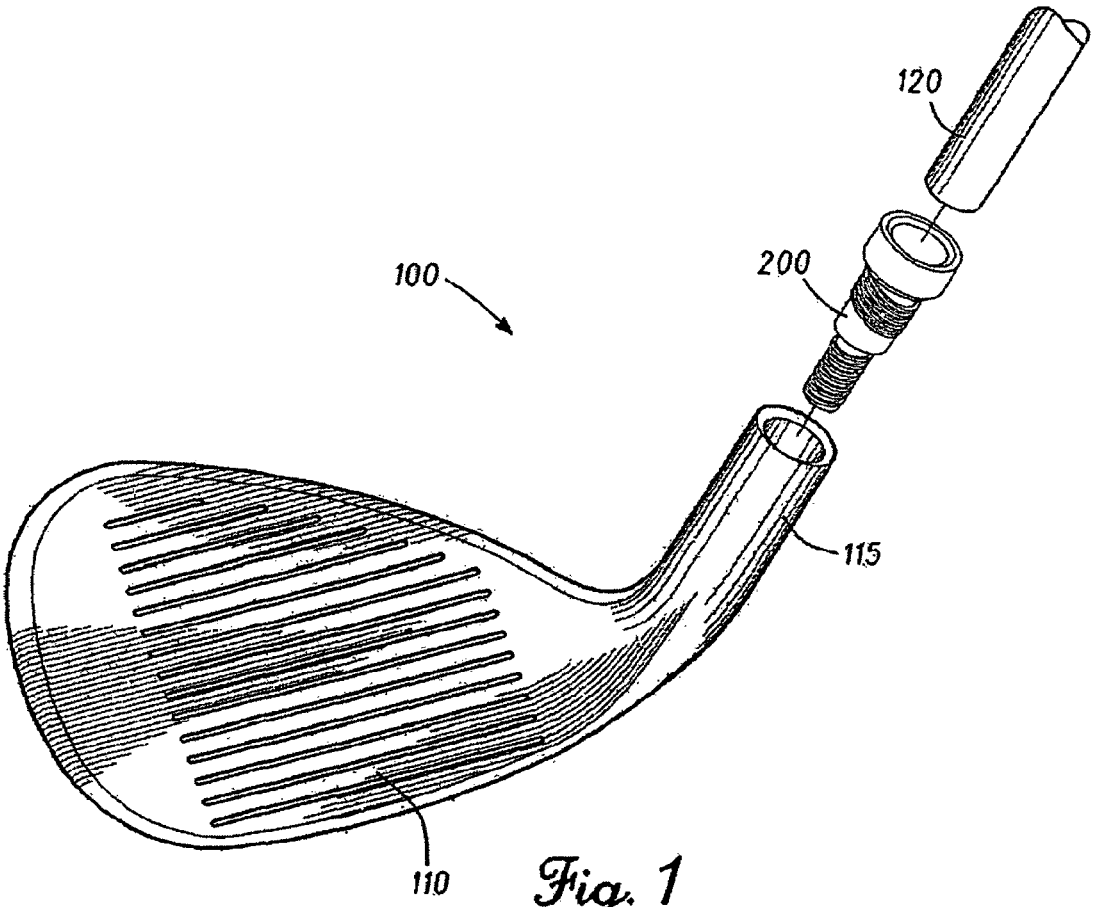
FIG. 1 is a perspective diagram representation of an example interchangeable golf club system according to an embodiment of the methods and apparatus for interchangeably coupling golf club heads and shafts described herein.

In the example of FIG. 1, an interchangeable golf club system 100 may include one or more golf club heads, generally shown as 110, and one or more shafts, generally shown as 120. The interchangeable golf club system 100 may be associated with a custom fitting system for golf clubs. In one example, the interchangeable golf club system 100 may be associated with the PING® color code system.

The golf club head 110 may be associated with various characteristics (e.g., shapes, weights, size, loft, lie, etc.). In one example, the golf club head 110 may be a club head for either a right-handed golf club or a club head for a left-handed golf club. The golf club head 110 may be made of zinc, aluminum alloys, stainless steel, titanium, titanium alloys, tungsten, any combination thereof, and/or other suitable types of materials.

Although FIG. 1 may depict an iron-type club head (e.g., 1-iron, 2-iron, 3-iron, 4-iron, 5-iron, 6-iron, 7-iron, 8-iron, 9-iron, pitching wedge, sand wedge, lob wedge, etc.), the methods and apparatus described herein may be readily applicable to other suitable types of golf club heads. For example, the methods and apparatus described herein may be applicable to golf club heads for metal woods (e.g., drivers, fairway woods, etc.), hybrids, putters or other suitable types of golf club heads.

The shaft 120 may be associated with various characteristics (e.g., flex, bend point, torque, length, etc.). The shaft 120 may be made of steel, graphite, any combination thereof, and/or other suitable types of materials.

The interchangeable golf club system 100 may also include a coupling device 200. In general, the coupling device 200 may provide various combinations of golf club heads and shafts by interchangeably coupling different golf club heads to different shafts. In one example, the coupling device 200 may couple the golf club head 110 to the shaft 120. The coupling device 200 may be steel, aluminum, plastic, a combination thereof, and/or other suitable types of materials. The methods and apparatus described herein are not limited in this regard.

Figure 2:
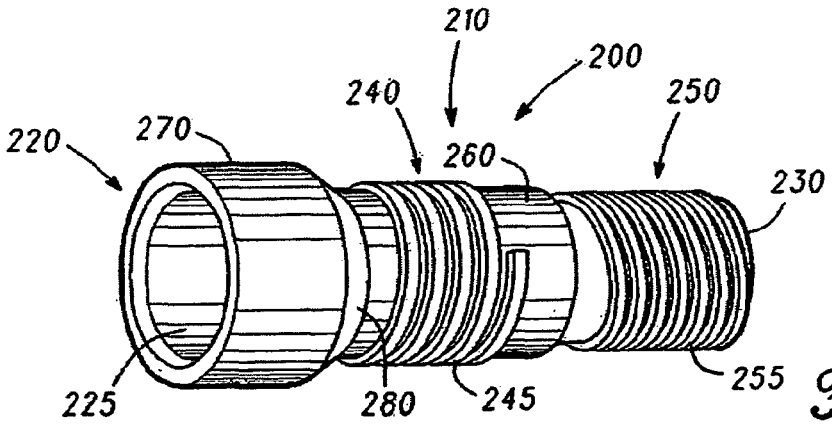
FIG. 2 is a perspective diagram representation of an example coupling device of FIG. 1.
Figure 3:
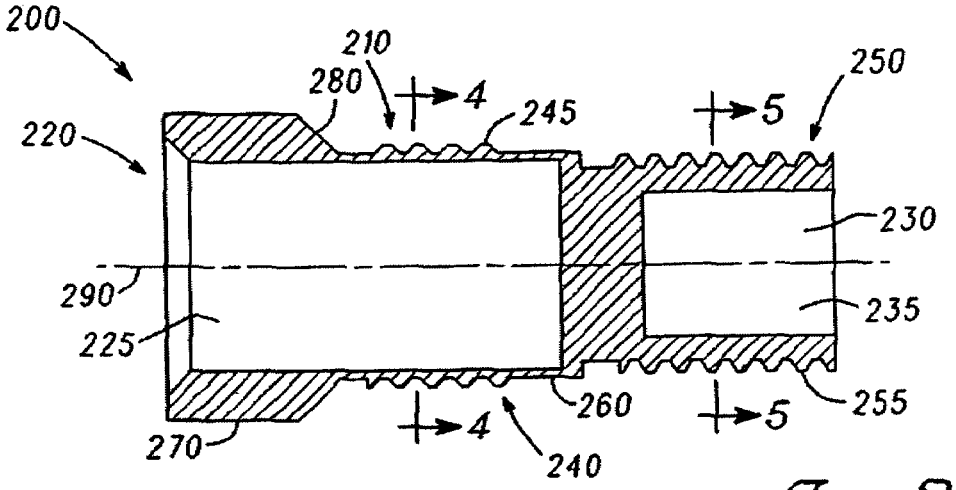
FIG. 3 depicts a side cross section of the example coupling device of FIG. 2.

Referring to FIGS. 2 and 3, for example, the coupling device 200 may include a body 210, a first end 220, and a second end 230. In particular, the body 210 may include two or more cylindrical and/or conical portions, generally shown as a first portion 240 and a second portion 250. The body 210 may also include a third portion 260. The body 210 may taper from the first end 220 to the second end 230.

Figure 4:
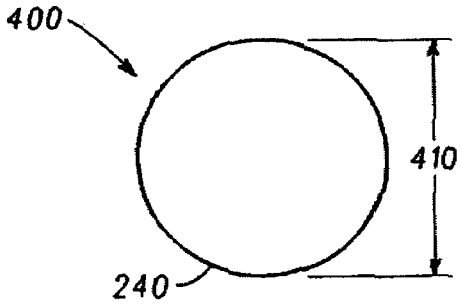
FIG. 4 depicts a cross section of the example coupling device of FIG. 2 along line 4-4.
Figure 5:
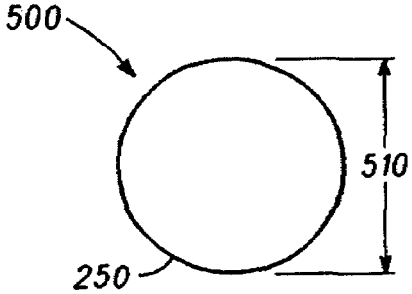
FIG. 5 depicts a cross section of the example coupling device of FIG. 2 along line 5-5.

The first portion 240 may be located at or proximate to the first end 220 whereas the second portion 250 may be located at or proximate to the second end 230. In the examples of FIGS. 4 and 5, a cross section 400 associated with the first portion 240 may include a first diameter 410 and a cross section 500 associated with the second portion 250 may include a second diameter 510, respectively. In one example, the first diameter 410 may be greater than the second diameter 510. Accordingly, the area of the cross section 400 is greater than the area of cross section 500. As noted above, for example, the first and second portions 240 and 250 may be cylindrical portions. Thus, a circumference of a cross section 400 associated with the first portion 240 may be greater than a circumference of a cross section 500 associated with the second portion 250. The methods and apparatus described herein are not limited in this regard.

Turning back to FIGS. 2 and 3, each of the first and second portions 240 and 250 may include one or more threaded portions, generally shown as a first external screw thread 245 and a second external screw thread 255, respectively. In one example, each of the first and second external screw threads 245 and 255 may include one or more helical ridges. In another example, each of the first and second external screw threads 245 and 255 may include one or more spiral ridges. Although FIG. 2 depicts a particular number of revolutions, each of the first and second external screw threads 245 and 255 may include additional or fewer revolutions.

The first external screw thread 245 may be associated with a golf club head having a first club head characteristic and the second external screw thread 255 may be associated with a golf club head having a second club head characteristic. The first and second club head characteristics may be opposite of each other or correlated in other suitable manner. In one example, the first external screw thread 245 may be associated with club heads for right-handed individuals (e.g., right-handed club heads) whereas the second external screw thread 255 may be associated with club heads for left-handed individuals (e.g., left-handed club heads). Alternatively, for example, the first external screw thread 245 may be associated with left-handed club heads whereas the second external screw thread 255 may be associated with right-handed club heads.

The coupling device 200 may interchangeably mate with or engage golf club heads via either the first external screw thread 245 or the second external screw thread 255 (e.g., male threaded portions). Based on whether the golf club head 110 is a right-handed club head or a left-handed club head, either the first external screw thread 245 or the second external screw thread 255 of the coupling device 200 may engage a threaded portion associated with the golf club head 110 (e.g., a female threaded portion such as the internal screw threads 640 and 840 of FIGS. 6 and 8, respectively). In one example, the threaded portion of the golf club head 110 may be located within a hosel 115. In another example, the threaded portion of the golf club head 110 may be within a crown (e.g., a metal wood golf club such as a driver) or the head itself.

As noted above, the coupling device 200 may be used to interchangeably couple right-handed golf club heads or left-handed golf club heads to the shaft 120. Accordingly, the first external screw thread 245 may be configured to engage either right-handed golf club heads or left-handed golf club heads, and the second external screw thread 255 may be configured to engage the opposite type of golf club heads. In one example, the first external screw thread 245 may engage the threaded portion of a golf club head if the golf club head is a right-handed golf club head (i.e., the second external screw thread 255 may not engage an internal screw thread of the golf club head). In contrast, the second external screw thread 255 may engage the threaded portion of a golf club head if the golf club head is a left-handed golf club head (i.e., the first external screw thread 245 may not engage an internal screw thread of the golf club head).

Alternatively, the first external screw thread 245 may engage the internal screw thread if the golf club head is a left-handed golf club head (i.e., the second external screw thread 255 may not engage an internal screw thread of the golf club head). In contrast, the second external screw thread 255 may engage the internal screw thread if the golf club head is a right-handed golf club head (i.e., the first external screw threads 245 may not engage an internal screw thread of the golf club head).

If the golf club head 110 is a right-handed golf club head, for example, an individual may secure the coupling device 200 to the golf club head 110 by inserting the coupling device 200 into the hosel 115 of the golf club head 110 and turning the coupling device 200 in a counter-clockwise manner (e.g., to the left). To disengage the coupling device 200 from the golf club head 110, an individual may turn the coupling device 200 in a clockwise manner (e.g., to the right).

Otherwise if the golf club head 110 is a left-handed golf club head, an individual may secure the coupling device 200 to the golf club head 110 by inserting the coupling device 200 into the hosel 115 of the golf club head 110 and turning the coupling device 200 in a clockwise manner (e.g., to the right). To disengage the coupling device 200 from the golf club head 110, an individual may turn the coupling device 200 in a counter-clockwise manner (e.g., to the left). Thus, the coupling device 200 may operate in an ambidextrous manner because the coupling device 200 may couple either a right-handed golf club head or a left-handed golf club bead to the shaft 120.

Figure 6:
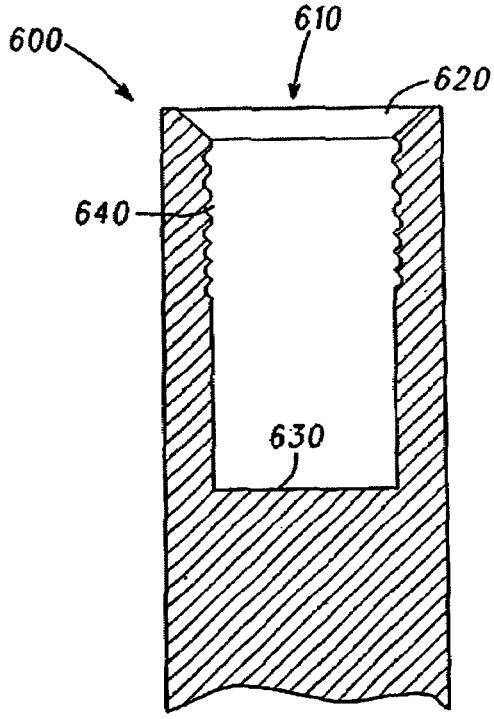
FIG. 6 depicts a side cross section of an example hosel.

In the example of FIG. 6, the hosel 600 of a golf club head may include a bore 610. The bore 610 may include a first end 620, a second end 630, and an internal screw thread 640. For example, the internal screw thread 640 may be located at or proximate to the first end 620 of the bore 610. The hosel 600 may be associated with a preference and/or a characteristic of a golf club and/or an individual.

Figure 7:
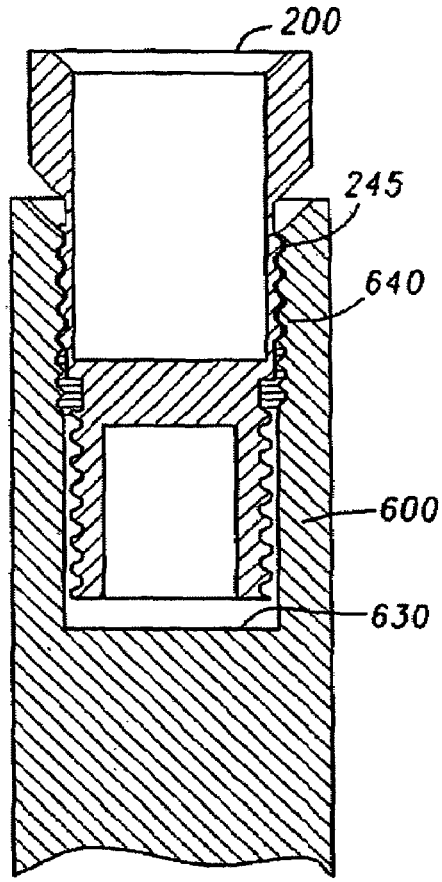
FIG. 7 depicts a side cross section of the example coupling device of FIG. 2 and the example hosel of FIG. 6.

In one example, the hosel 600 may be associated with a right-handed golf club head. Turning to FIG. 7, for example, an individual may secure the coupling device 200 to the hosel 600 by inserting the coupling device 200 into the hosel 600 and turning the coupling device 200 in a counter-clockwise manner (e.g., to the left). In particular, the first external screw thread 245 of the coupling device 200 may engage the internal screw thread 640. To disengage the coupling device 200 from the hosel 600, an individual may turn the coupling device 200 in a clockwise manner (e.g., to the right).

In contrast, if the hosel 600 is associated with a left-handed golf club head, an individual may secure the coupling device 200 to the hosel 600 by inserting the coupling device 200 into the hosel 600 and turning the coupling device 200 in a clockwise manner (e.g., to the right). To disengage the coupling device 200 from the hosel 600, an individual may turn the coupling device 200 in a counter-clockwise manner (e.g., to the left). The methods and apparatus described herein are not limited in this regard.

Figure 8:
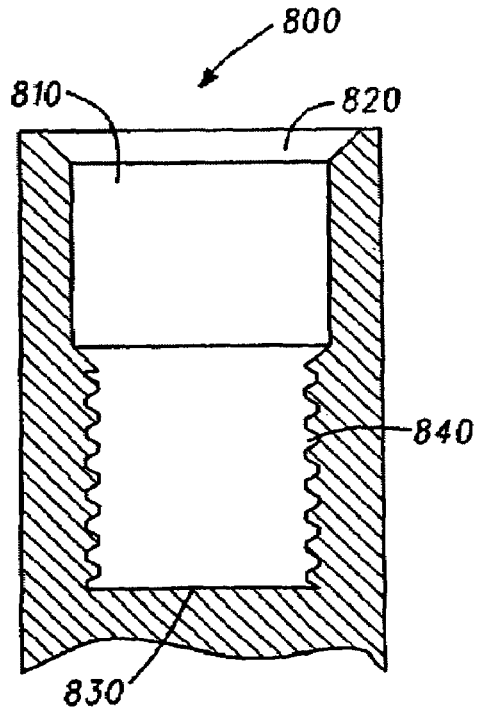
FIG. 8 depicts a side cross section of another example hosel.

In the example of FIG. 8, the hosel 800 of a golf club head may include a bore 810. The bore 810 may include a first end 820, a second end 830, and an internal screw thread 840. For example, the internal screw thread 840 may be located at or proximate to the second end 830 of the bore 810. The hosel 800 may be associated with a preference and/or a characteristic of a golf club and/or an individual.

Figure 9:
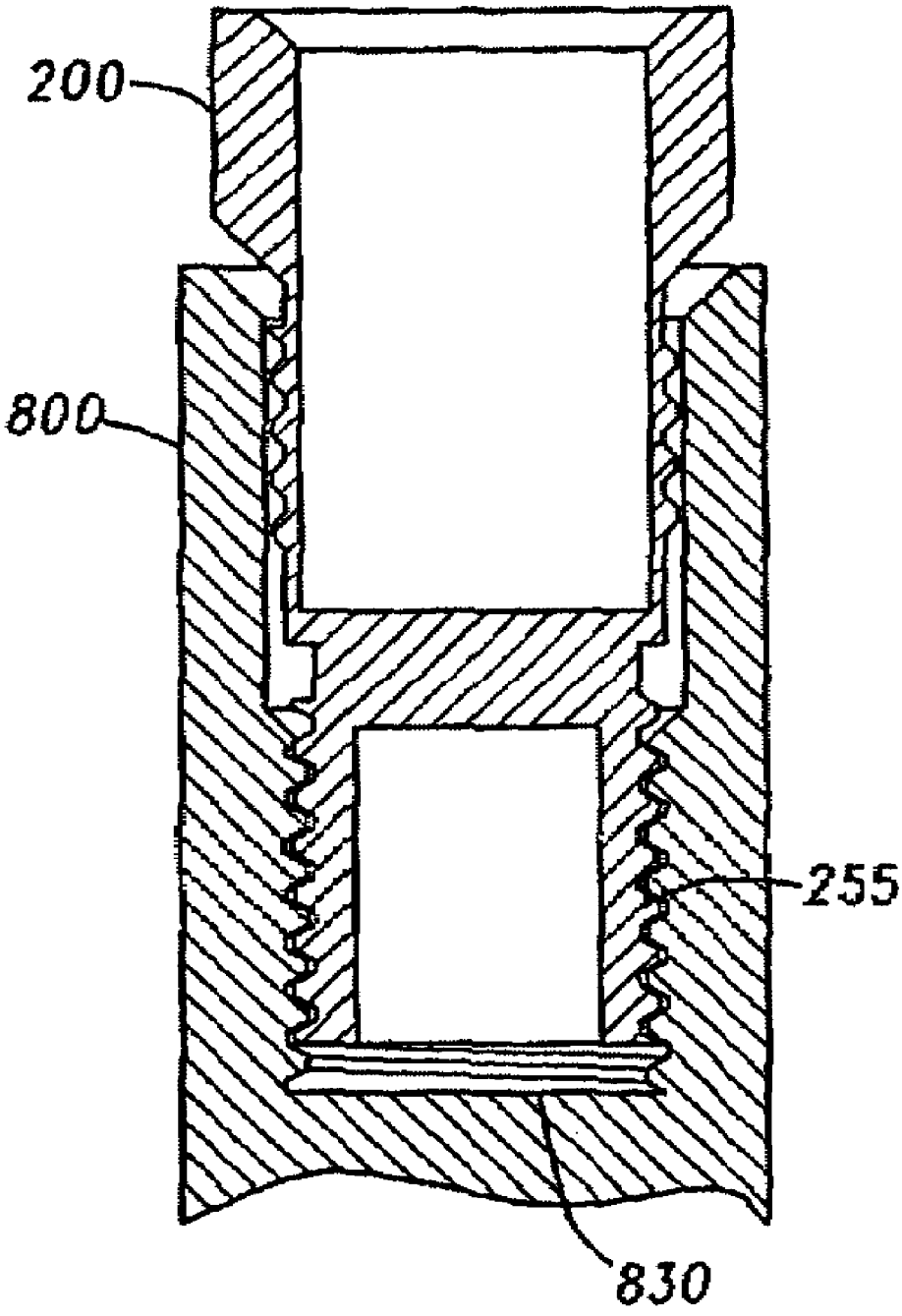
FIG. 9 depicts a side cross section of the example coupling device of FIG. 2 and the example hosel of FIG. 8.

In one example, the hosel 800 may be associated with a right-handed golf club head. Turning to FIG. 9, for example, an individual may secure the coupling device 200 to the hosel 800 by inserting the coupling device 200 into the hosel 800 and turning the coupling device 200 in a counter-clockwise manner (e.g., to the left). In particular, the second external screw thread 255 of the coupling device 200 may engage the internal screw thread 840. To disengage the coupling device 200 from the hosel 800, an individual may turn the coupling device 200 in a clockwise manner (e.g., to the right).

Otherwise if the hosel 800 is associated with a left-handed golf club head, an individual may secure the coupling device 200 to the hosel 800 by inserting the coupling device 200 into the hosel 800 and turning the coupling device 200 in a clockwise manner (e.g., to the right). To disengage the coupling device 200 from the hosel 800, an individual may turn the coupling device 200 in a counter-clockwise manner (e.g., to the left). The methods and apparatus described herein are not limited in this regard.

Although the above examples describe the bores 610 and 810 being located within the hosels 600 and 800, respectively, each of the bores 610 and 810 may be located within a crown of a golf club head or the head itself. Further, while the above examples describe the coupling device 200 engaging golf club heads, the coupling device 200 may engage shafts in a similar manner. The methods and apparatus described herein are not limited in this regard.

Referring back to FIGS. 2 and 3, the body 210 may also include a third portion 260 to separate the first and second portions 240 and 250. For example, the third portion 260 may be a non-threaded portion of the body 210 (e.g., a ridge-less surface). The third portion 260 may prevent rotation of the coupling device 200. In one example, the third portion 260 may prevent further rotation of the coupling device 200 in response to the first external screw thread 245 being engaged with the internal screw thread 640 (FIG. 7). In another example, the third portion 260 may prevent further rotation of the coupling device 200 in response to the second external screw thread 255 being engaged with the internal screw thread 850 (FIG. 9). Although FIGS. 2 and 3 depict the third portion 260, the first and second portions 240 and 250 may be adjacent to each other such that the body 210 may not include the third portion 260.

In addition, the coupling device 200 may include a flange 270. The flange 270 may be located at or proximate to the first end 220. The flange 270 may be used to support a portion of the shaft 120 inserted into the coupling device 200.

The coupling device 200 may also include a chamfer 280. The chamfer 280 may be located at or proximate to the first end 220. In one example, the chamfer 280 may be located between the flange 270 and the first portion 240 of the body 210. In another example, the coupling device 200 may not include the flange 270. Accordingly, the chamfer 280 may be located at the first end 220. The chamfer 280 may be used to align the coupling device 200 with the golf club head 110 along the axis 290. As a result, the chamfer 280 may prevent axial displacement of the golf club head 110 relative to the shaft 120.

The coupling device 210 may also include a bore 225 at the first end 220 to receive a portion of the shaft 120. In one example, the bore 225 may be a cylindrical bore, a conical bore, a combination thereof, or any other suitable type of bores. The shaft 120 may be inserted into and attached to the coupling device at the bore 225. For example, the shaft 120 may be attached to the bore 225 using epoxy, glue, or other suitable types of adhesives.

The coupling device 200 may include a cavity 235 at the second end 230. The cavity 235 may hold one or more internal weights (not shown) to balance the golf club system 100. For example, the internal weight may be tungsten or any other suitable type of materials. The cavity 235 may be separate from the bore 225 to keep adhesives used to attach the shaft 120 to the coupling device 200 from reaching the golf club head 110.

While the above examples describe various portions and/or components of the coupling device 200, the coupling device 200 may not include certain portions and/or components. In one example, the coupling device 200 may not include the third portion 260. As a result, the first and second portions 240 and 250 may be adjacent to each other. In another example, the coupling device 200 may not include the flange 270. Thus, the chamfer 280 may be located at the first end 220 instead of the flange 270. The methods and apparatus described herein are not limited in this regard.

Figure 10:
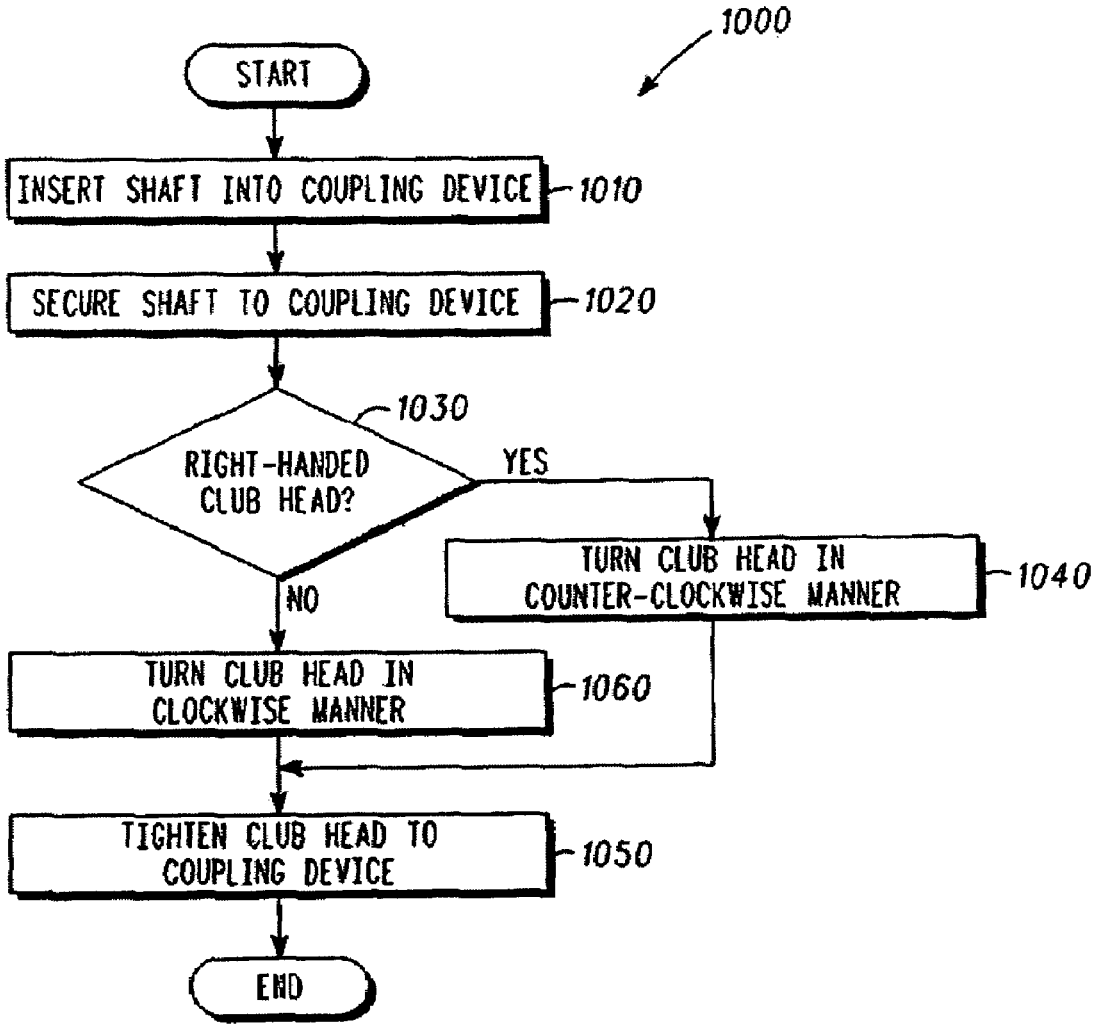
FIG. 10 is a flow diagram representation of one manner in which the example coupling device of FIG. 2 may be used.

In the example of FIG. 10, a process 1000 begins with inserting the shaft 120 into the bore 225 of the coupling device 200 (block 1010). The shaft 120 may be secured to the bore 225 with adhesive (block 1020).

As noted above, the coupling device 200 may be interchangeably coupled to golf club heads. For example, the coupling device 200 may be inserted into the hosel 115 of the golf club head 110 (block 1030). The golf club head 110 may be secured to the coupling device 200 based on whether the golf club head 110 is a right-handed club head (e.g., the club face is on the left side of the golf club head 110) or a left-handed club head (e.g., the club face is on the right side of the golf club head 110). In one example, the golf club head 110 may be secured to the coupling device 200 by turning the golf club head 110 in a counter-clockwise manner if the golf club head 110 is a right-handed club head (block 1040) and tightening the golf club head 110 to the coupling device 200 (block 1050). Alternatively, the golf club head 110 may be secured to the coupling device 200 by turning the golf club head 110 in a clockwise manner if the golf club head 110 is a left-handed club bead (block 1060) and tightening the golf club head 110 to the coupling device 200 (block 1050). The methods and apparatus described herein are not limited in this regard.

Although a particular order of actions is illustrated in FIG. 10, these actions may be performed in other temporal sequences. For example, two or more actions depicted in FIG. 10 may be performed sequentially, concurrently, or simultaneously.

Although the methods and apparatus are described herein with respect to golf club heads and shafts, the methods and apparatus described herein are readily applicable to other golf club parts or components. For example, the methods and apparatus described herein are readily applicable to interchangeably couple grips and shafts. Further, the methods and apparatus described herein are readily applicable to other non-golf club parts or components.

Although certain example methods, apparatus, and/or articles of manufacture have been described herein, the scope of coverage of this disclosure is not limited thereto. On the contrary, this disclosure covers all methods, apparatus, and/or articles of manufacture fairly falling within the scope of the appended claims either literally or under the doctrine of equivalents.

What is claimed is:

1. A method for manufacturing a coupling device for golf clubs, the method comprising:

forming a first portion of a body of the coupling device to interchangeably couple a first golf club head with a golf club shaft, the first golf club head being associated with a right-handed golf club; and forming a second portion of the body of the coupling device to interchangeably couple a second golf club head with the golf club shaft, the second golf club head being associated with a left-handed golf club;

wherein the first portion is incompatible to couple the second golf club head to the golf club shaft, and the second portion is incompatible to couple the first golf club head to the golf club shaft.

2. The method of claim 1, wherein:

forming the first portion further comprises:

forming a first set of ridges on a surface of the first portion; and forming the second portion further comprises:

forming a second set of ridges on a surface of the second portion;

wherein:

the first and second sets of ridges each comprise one or more ridges;

the first set of ridges cannot secure the second golf club head to the golf club shaft; and the second set of ridges cannot secure the first golf club head to the golf club shaft.

3. The method of claim 2, further comprising:

forming a ridge-less portion between the first and second sets of ridges.

4. The method of claim 2, further comprising:

forming a ridge-less portion between the first and second sets of ridges to comprise a first cross-section that is:

smaller than a second cross-section proximate to a first end of the coupling device; and greater than a third cross-section proximate to a second end of the coupling device.

5. The method of claim 2, further comprising:

forming a flange proximate to a first end of the coupling device; and forming a chamfer between the flange and one of the first and second sets of ridges;

wherein the flange comprises a bore to hold a portion of the golf club shaft.

6. The method of claim 2, wherein:

at least one of the first and second sets of ridges comprise at least one of a helical ridge and a spiral ridge.

7. The method of claim 2, wherein:

forming the first set of ridges comprises:

forming at least one external clockwise screw thread on the first portion to couple the first golf club head with the golf club shaft when the first golf club head is rotated onto the at least one external clockwise screw thread of the first portion, and forming the second set of ridges comprises:

forming at least one external counterclockwise screw thread on the second portion to couple the second golf club head to the golf club shaft when the second golf club head is rotated onto the at least one external counterclockwise screw thread of the second portion.

8. The method of claim 2 wherein:

forming the first set of ridges comprises:

forming at least one external counterclockwise screw thread on the first portion to couple the first golf club head with the golf club shaft when the first golf club head is rotated onto the at least one external counterclockwise screw thread of the first portion; and forming the second set of ridges comprises:

forming at least one external clockwise screw thread on the second portion to couple the second golf club head to the golf club shaft when the second golf club head is rotated onto the at least one external clockwise screw thread of the second portion.

9. The method of claim 1, wherein:

forming the second portion further comprises:

forming the second portion to comprise a second cross section area; and forming the first portion further comprises:

forming the first portion to comprise a first cross section area greater than the second cross section area.

10. The method of claim 1, further comprising:

forming a cavity proximate to one end of the coupling device to hold an insert weight.

11. The method of claim 1, wherein:

forming the first portion further comprises:

forming a diameter of a cross section of the first portion to be substantially constant along a length of the first portion; and forming the second portion further comprises:

forming a diameter of a cross section of the second portion to be substantially constant along a length of the second portion.

12. The method of claim 1, wherein:

forming the first portion further comprises:

tapering the first portion to fit within a complementary conical section of a bore in the first golf club head; and forming the second portion further comprises:

tapering the second portion to fit within a complementary conical section of a bore in the second golf club head.

13. The method of claim 1, further comprising:

forming a tapering from a first end to a second end of the coupling device;

wherein:

one of the first portion and the second portion is located proximate to the first end, and another one of the first portion and the second portion is located proximate to the second end.

14. The method of claim 1, wherein:

forming the second portion of the coupling device further comprises:

forming the second portion with a different diameter than the first portion of the coupling device.

15. The method of claim 1, wherein:

forming the first and second portions of the coupling device further comprises:

forming the coupling device to taper from the first portion to the second portion.

16. The method of claim 1, wherein:

forming the first and second portions of the coupling device further comprises:

forming the coupling device to taper from the second portion to the first portion.

17. The method of claim 1, wherein:

forming the first and second portions of the coupling device further comprises:

forming at least one ridge at each of the first and second portions.

18. The method of claim 1, wherein:

forming the first and second portions of the coupling device further comprises:

forming at least one screw thread at each of the first and second portions.

19. The method of claim 1, wherein:

forming the first and second portions of the coupling device further comprises:

forming each of the first and second portions to comprise a cylindrical shape.

20. A method for manufacturing a golf club coupling system, the method comprising:

providing a body having a first end and a second end, the body tapers from the first end to the second end;

providing a non-threaded bore at the first end to interchangeably couple the body to a portion of a shaft;

providing a first male threaded portion at or proximate to the first end to interchangeably mate with a first female threaded portion, the first female threaded portion being associated with a first golf club head having a first characteristic;

providing a second male threaded portion at or proximate to the second end to interchangeably mate with a second female threaded portion, the second female threaded portion being associated with a second golf club head having a second characteristic; and providing a non-threaded portion between the first male threaded portion and the second male threaded portion;

wherein:

the first and second characteristics are opposite of each other; and the body, the first and second male threaded portions, and the non-threaded portion form a single piece.

21. The method of claim 20, wherein:

the first characteristic is a right-handed golf club; and the second characteristic is a left-handed golf club.

22. The method of claim 20, wherein:

providing the non-threaded portion further comprises:

forming the non-threaded portion to comprise a first circumference;

providing the first male threaded portion further comprises:

forming the first male threaded portion to comprise a second circumference greater than the first circumference; and providing the second male threaded portion further comprises:

forming the second male threaded portion to comprise a third circumference smaller than the first circumference.

23. The method of claim 20, wherein:

providing the first male threaded portion further comprises:

forming the first male threaded portion to comprise a first circumference; and providing the second male threaded portion further comprises:

forming the second male threaded portion to comprise a second circumference greater than the first circumference.

24. The method of claim 20, wherein:

providing the first male threaded portion further comprises:

forming the first male threaded portion to comprise at least one first thread and a substantially constant first diameter when excluding the at least one first thread; and providing the second male threaded portion further comprises:

forming the second male threaded portion to comprise at least one second thread and a substantially constant second diameter when excluding the at least one second thread.

25. The method of claim 20, further comprising:

forming a flange proximate to the first end of the body; and forming a chamfer between the flange and at least one of the first and second male threaded portions.

26. The method of claim 20, further comprising:

forming a cavity at the second end to hold an insert weight.

27. A method for manufacturing a golf club coupling system, the method comprising:

providing a first golf club head;

providing a second golf club head;

providing a shaft; and providing a coupling device;

wherein providing the coupling device comprises:

configuring a first end of the coupling device to couple with the shaft;

configuring a first portion of the coupling device to:

be compatible for coupling with the first golf club head; and be incompatible for coupling with the second golf club head; and configuring a second portion of the coupling device to:

be compatible for coupling with the second golf club head; and be incompatible for coupling with the first golf club head.

28. The method of claim 27 further comprising:

coupling together the golf club shaft and the coupling device.

29. The method of claim 27, further comprising at least one of:

coupling the first golf club head to the coupling device by turning the first portion of the coupling device in a first direction onto the first golf club head; or coupling the second golf club head to the coupling device by turning the second portion of the coupling device in a second direction onto the second golf club head.

30. The method of claim 29, further comprising:

configuring the golf club coupling system for at least one of:

a first configuration wherein:

the first direction is clockwise;

the second direction is counterclockwise;

the first golf club head is right-handed; and the second golf club head is left-handed;

a second configuration wherein:

the first direction is clockwise;

the second direction is counterclockwise;

the first golf club head is left-handed; and the second golf club head is right-handed;

a third configuration wherein:

the first direction is counterclockwise;

the second direction is clockwise;

the first golf club head is right-handed; and the second golf club head is left-handed; or a fourth configuration wherein:

the first direction is counterclockwise;

the second direction is clockwise;

the first golf club head is left-handed; and the second golf club head is right-handed.

* * * * *

UNITED STATES PATENT AND TRADEMARK OFFICE

CERTIFICATE OF CORRECTION

PATENT NO. : 7,601,075 B2
APPLICATION NO. : 12/171207
DATED : October 13, 2009
INVENTOR(S) : Cole et al.

It is certified that error appears in the above-identified patent and that said Letters Patent is hereby corrected as shown below:

Title Page, Column 1 (Title), line 2, delete "GOLD" and insert --GOLF-- after the text reading "INTERCHANGEABLY COUPLING"

Column 1, line 2, delete "GOLD" and insert --GOLF-- after the text reading "INTERCHANGEABLY COUPLING"

Signed and Sealed this

Nineteenth Day of January, 2010

David J. Kappos

David J. Kappos
*Director of the United States Patent and Trademark Office*